US008237339B2

(12) United States Patent
Chen et al.

(10) Patent No.: US 8,237,339 B2
(45) Date of Patent: Aug. 7, 2012

(54) LED ILLUMINATING DEVICE

(75) Inventors: Fen Chen, Shenzhen (CN); Ting Dong, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/941,973

(22) Filed: Nov. 8, 2010

(65) Prior Publication Data

US 2011/0181166 A1 Jul. 28, 2011

(30) Foreign Application Priority Data

Jan. 23, 2010 (CN) ..... 2010 1 0300627

(51) Int. Cl.
*H01J 1/02* (2006.01)

(52) U.S. Cl. ..... 313/46; 362/191

(58) Field of Classification Search ..... 313/46; 362/190–191, 545, 612, 249.01
See application file for complete search history.

(56) References Cited

U.S. PATENT DOCUMENTS 7,497,596 B2 * 3/2009 Ge ..... 362/294
2011/0075412 A1 * 3/2011 Wu et al. ..... 362/235

FOREIGN PATENT DOCUMENTS

CN 2775467 Y 4/2006
CN 201137904 Y 10/2008

* cited by examiner

*Primary Examiner* — Joseph L Williams
*Assistant Examiner* — Brenitra Lee
(74) *Attorney, Agent, or Firm* — Altis Law Group, Inc.

(57) ABSTRACT

An LED illuminating device includes a heat sink, a first substrate, a second substrate and a connector. The heat sink comprises a first end, a second end opposite to the first end along the axial direction of the heat sink. The first substrate mounted on the first end, the second substrate mounted on the second end, the second substrate has a size smaller than the first substrate. Heat generated by the first substrate is transferred to air and will not accumulate and be transferred to the second substrate. Additionally, because the first substrate and the second substrate are spaced by the heat sink, the heat radiation efficiency is improved.

13 Claims, 7 Drawing Sheets

LED ILLUMINATING DEVICE

BACKGROUND

1. Technical Field

The present disclosure relates to light emitting diode (LED) illuminating devices, especially to an LED illuminating device with heat dissipation module.

2. Description of Related Art

Compared to many other kinds of illuminating devices, LED lamps have many advantages, such as high luminous efficiency, low power consumption, and long service life. Yet, LED lights still have disadvantages. Because light emitted by LEDs is directional, light divergence angle of LEDs is less than those of some other kinds of illuminating devices, such as light bulbs.

The light divergence angle of an LED is about 60 degrees. Several LEDs can be combined in a single LED illuminating device to enlarge the light divergence angle. Referring to FIG. 1, a conventional ring shaped LED illuminating device including a number of substrates is shown. The light divergence angle of the LED illuminating device is enlarged, however, more heat is produced by the LEDs (shown as arrows) between substrates, making the LED illuminating devices too hot.

Therefore, what is needed is a LED illuminating device with large light divergence angle and good heat dissipation ability.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The disclosure, including the accompanying, is illustrated by way of example and not by way of limitation. It should be noted that references to "an" or "one" embodiment in this disclosure are not necessarily to the same embodiment, and such references mean at least one.

Figure 1:
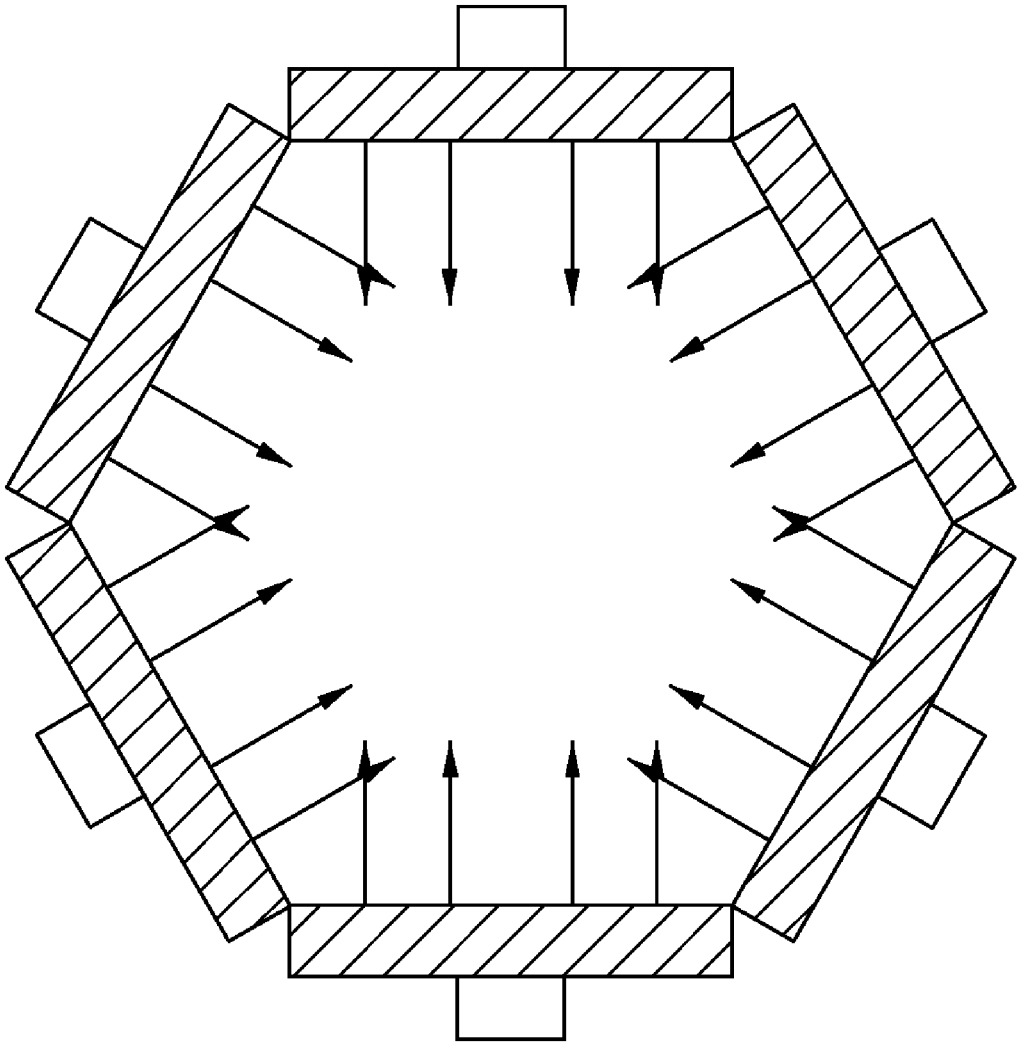
FIG. 1 (RELATED ART)
FIG. 1 is a schematic view showing a conventional ring shaped LED illuminating device.
Figure 2:
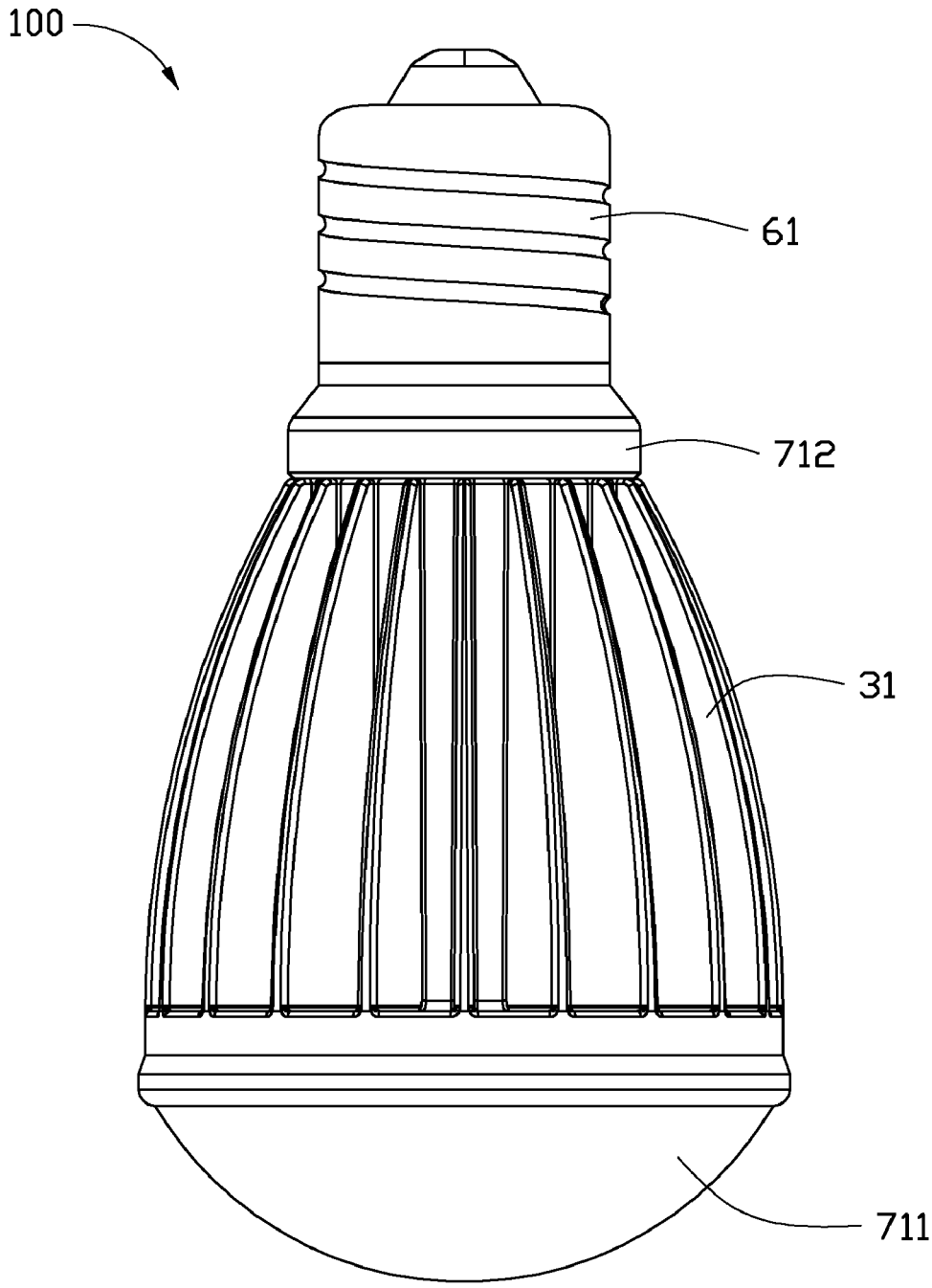
FIG. 2 is a front planar view of an LED illuminating device according to a first embodiment.

Referring to FIG. 2, a light emitting diode (LED) illuminating device 100 according to a first embodiment is disclosed. The LED illuminating device 100 includes a connector 61, a heat sink 31, a first cover 711, and a second cover 712.

Figure 3:
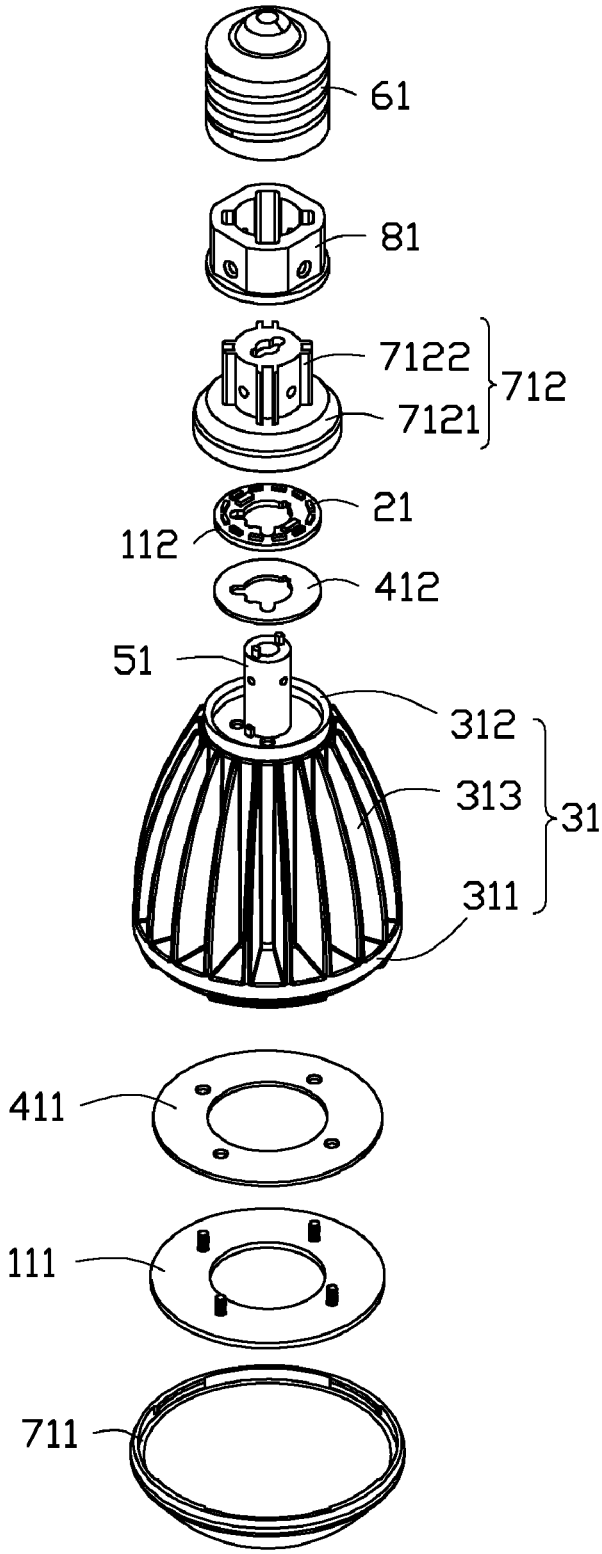
FIG. 3 is an isometric, exploded view of the LED illuminating device of FIG. 2.
Figure 4:
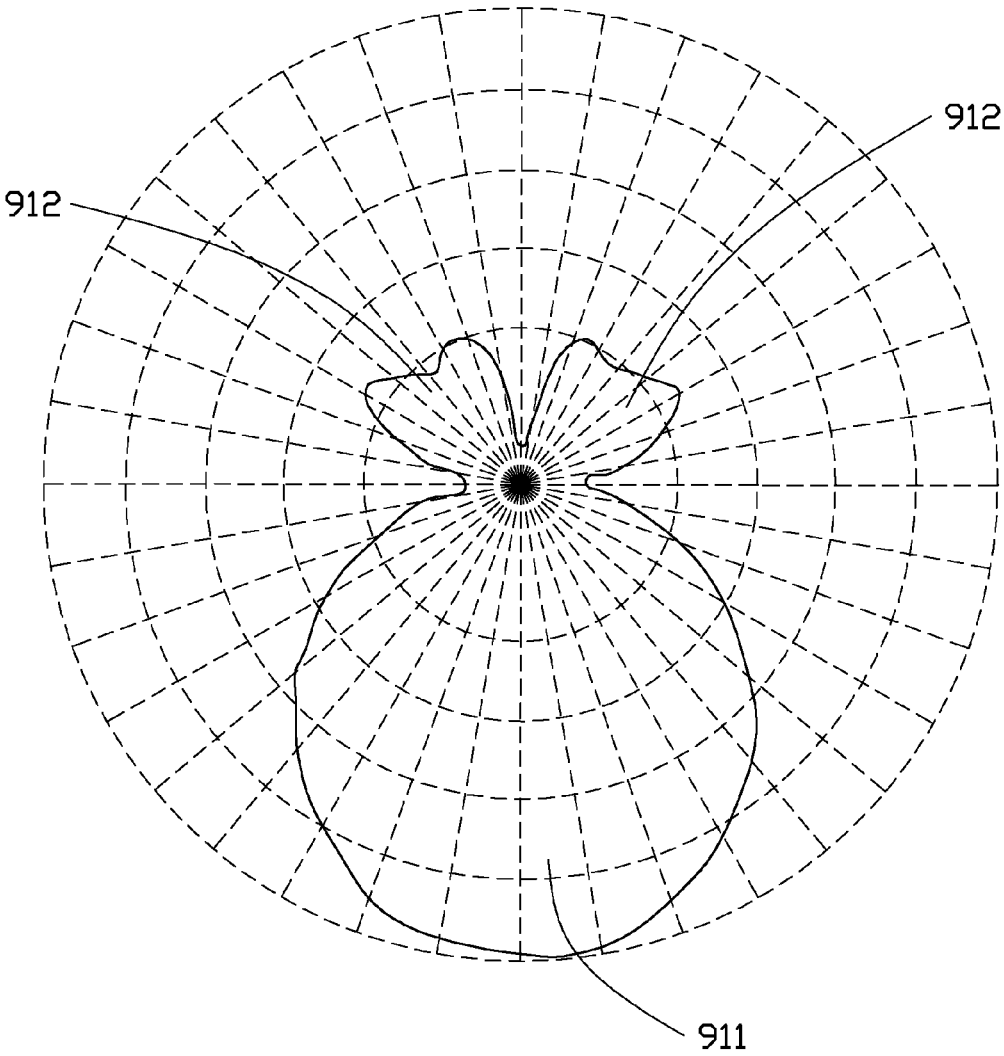
FIG. 4 is a diagram showing the radiation pattern of the LED illuminating device of FIG. 2.

Referring to FIG. 3, the heat sink 31 is truncated cone structure, and includes a first end 311 and a second end 312 opposite to the first end 311 along the axial direction of the heat sink 31. The diameter of the first end 311 is greater than that of the second end 312. The heat sink 31 further includes a number of cooling fins 313 arranged around its lateral surface. The radial height of each cooling fin 313 gradually decreases from the first end 311 to the second end 312. The heat sink 31 can be made of metal with good heat conductivity, such as copper or aluminum.

A first substrate 111 is fixed to the first end 311 of the heat sink 31. A first heat plate 411 is arranged between the first substrate 111 and the first end 311. The first cover 711 is mounted on the first substrate 111. A number of LEDs 21 are mounted on the first lighting substrate 111. The first cover 711 may be transparent or translucent.

A second substrate 112 is fixed to the second end 312 of the heat sink 31. A second heat plate 412 is arranged between the second substrate 112 and the second end 312. The second cover 712 is mounted on the second substrate 112, and includes a light diffuser 7121 and a connecting member 7122. A number of LEDs 21 are mounted on the second substrate 112 within the space defined by the diffuser 7121 and the second substrate 112. The diffuser 7121 may be transparent or translucent. The second cover 712 and the connector 61 are joined together by the connecting member 7122. The connecting member 7122 and the connector 61 are separated by an isolator 81 mounted around the connecting member 7122.

In the first embodiment, both of the first substrate 111 and the second substrate 112 can be annular structures. The external diameter of the second substrate 112 is less than the internal diameter of the first substrate 111.

A connecting component 51 extends through the second cover 712, the second substrate 112 and the heat sink 31, and is electrically connected to the first substrate 111, the second substrate 112, and the connector 61.

In the first embodiment, the LED illuminating device 100 is described as being used as a ceiling light for ease of description with the connector 61 being the top of the device 100 towards the ceiling, and the first cover 711 at the bottom of the device 100 toward the ground but may be mounted elsewhere such as on a wall and thus have a different orientation with the connector 61 and the cover 711 facing to the sides. The connector 61 can be electrically connected to a socket mounted on the ceiling. Because the diameter of the first end 311 is greater than that of the second end 312, heat generated by the first substrate 111 is transferred to the surrounding air and will not accumulate and be transferred to the second substrate 112. FIG. 3 is a diagram showing radiation pattern of the LED illuminating device 100. As can be seen in the diagram, the first region 911 is illuminated by the first substrate 111, and the second region 912 is illuminated by the second substrate 112. That is, the LED illuminating device 100 can simultaneously illuminate two regions located at two different directions.

In this embodiment, the first substrate 111 and the second substrate 112 face opposite directions and light from the second substrate 112 is directed to the sides through the diffuser 7121. Additionally, because the first substrate 111 and the second substrate 112 are spaced by the heat sink 31, the heat radiation efficiency is improved. The first end 311 and the second end 312 are designed to have different diameters, thereby avoiding that the second substrate 112 not only generating heat but also being heated by the first substrate 111.

Figure 5:
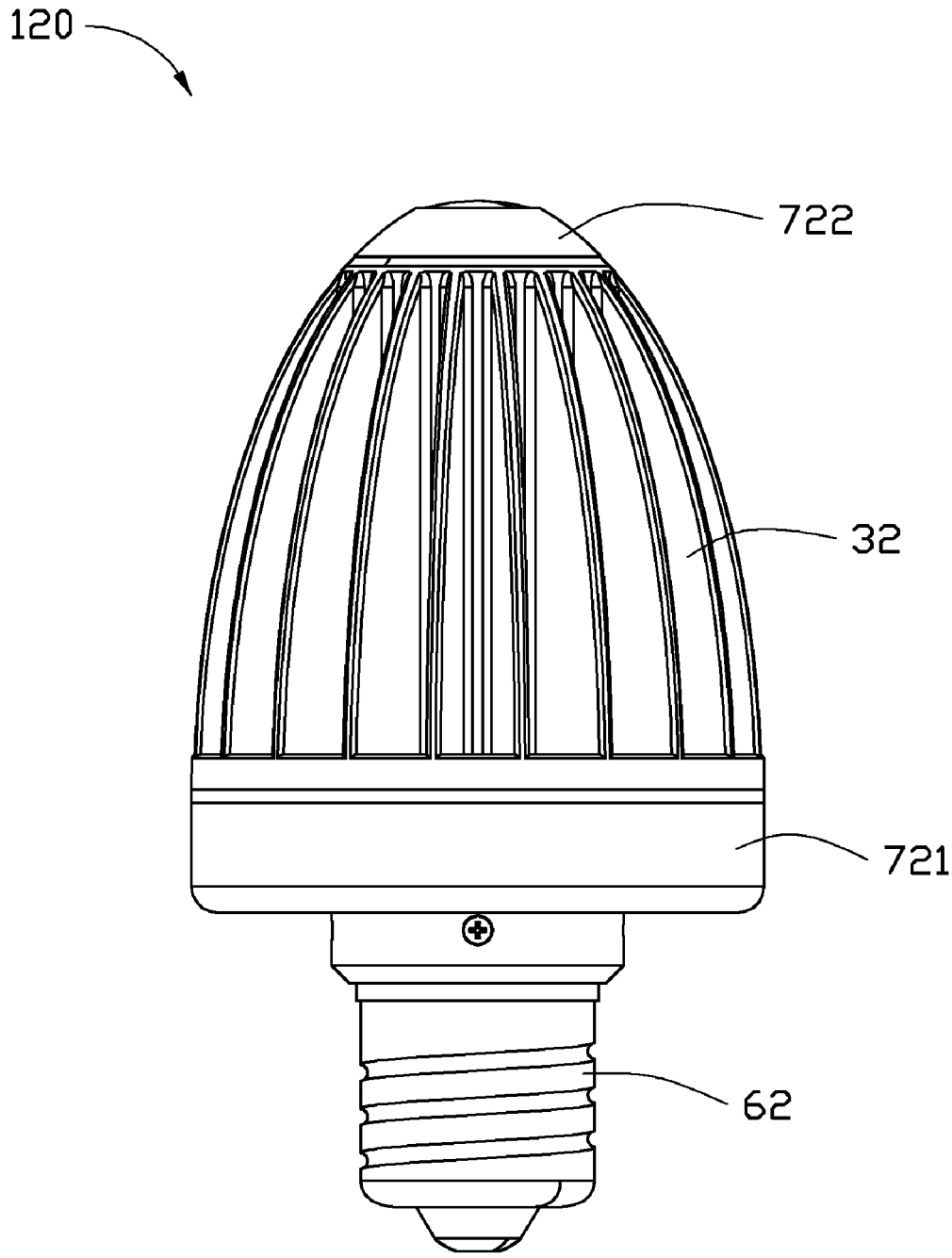
FIG. 5 is a planar view of an LED illuminating device according to a second embodiment.
Figure 6:
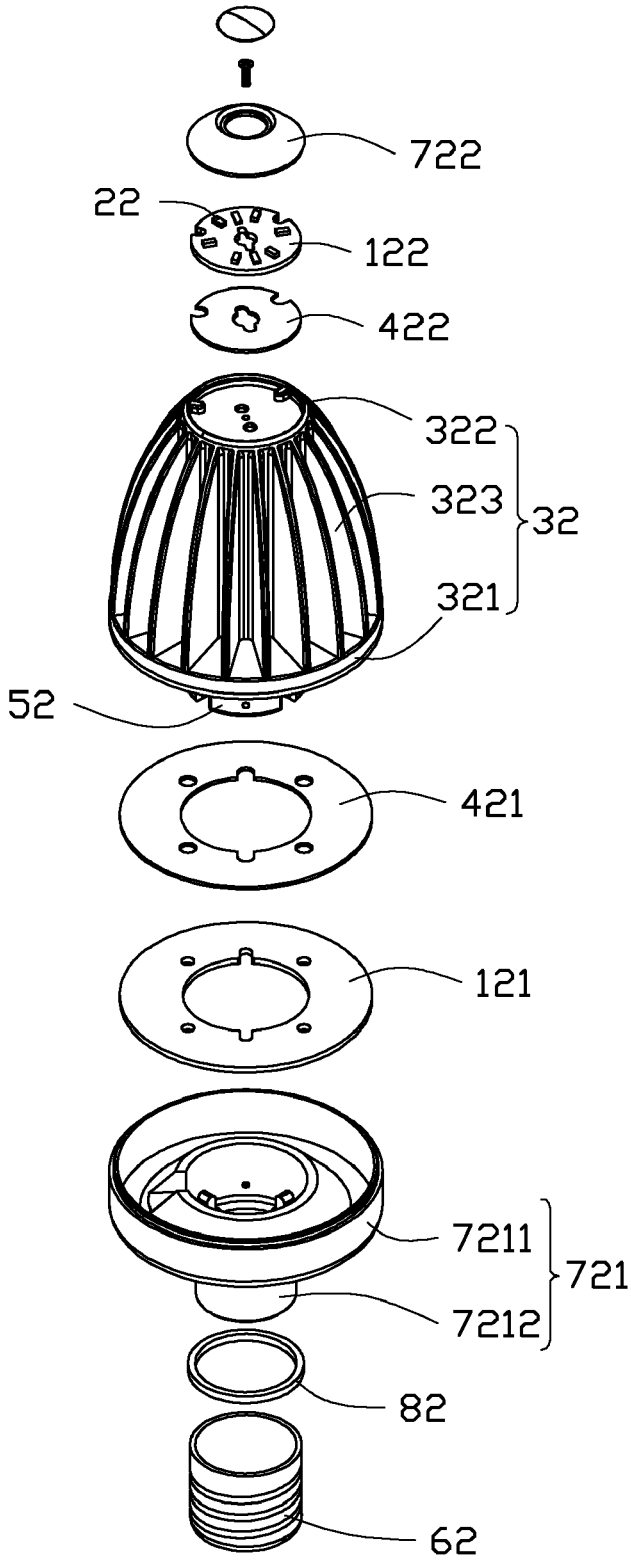
FIG. 6 is an isometric, exploded view of the LED illuminating device of FIG. 5.

Referring to FIGS. 5 and 6, an LED illuminating device 120 according to a second embodiment is disclosed. The LED illuminating device 120 includes a first substrate 121, a second substrate 122, a number of LEDs 22, a heat sink 32 with a plurality of cooling fins 323, a first heat plate 421, a second heat plate 422, a connecting component 52, a connector 62, a first cover 721, and a second cover 722.

The difference between the second embodiment and the first embodiment is that the first substrate 121 is annular, and the second substrate 122 is disc shaped. The diameter of the second substrate 122 is less than the internal diameter of the second substrate 121. The second cover 721 is arranged on the second substrate 122 which is mounted on the second end 322 of the heat sink 32. The first cover 721 is mounted on the first substrate 121 which is mounted on the first end 321 of the heat sink 32. The first cover 721 includes a light diffuser 7211 and a connecting member 7212. The first cover 721 and the connector 62 are joined together by the connecting member 7212. The connecting member 7212 and the connector 62 are separated by an isolator 82 mounted around the connecting member 7212. The connecting component 52 extends through the first cover 721, the first substrate 121, and the heat sink 32, and is electrically connected to the first substrate 121, the second substrate 122, and the connector 62.

Figure 7:
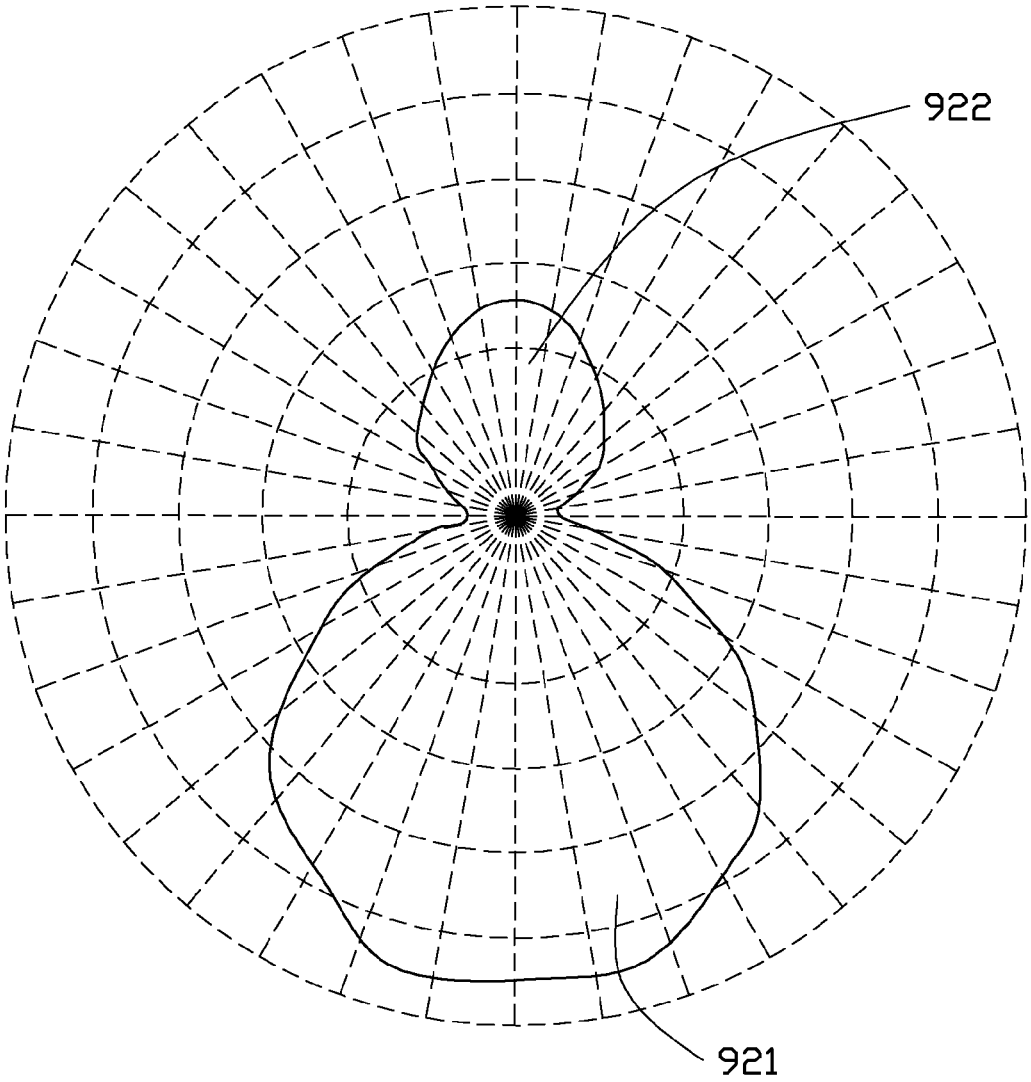
FIG. 7 is a diagram showing the radiation pattern of the LED illuminating device of FIG. 5.

In the second embodiment, the LED illuminating device 120 may, for example, be used in a desk lamp or a wall lamp. The connector 62 can be electrically connected with a socket. Because the diameter of the first end 321 is greater than that of the second end 322, heat generated by the first substrate 121 is transferred to the surrounding air and will not accumulate and be transferred to the second substrate 122. FIG. 7 is a diagram showing radiation pattern of the LED illuminating device 120. As can be seen in the diagram, the first region 921 is illuminated by the first substrate 121, and the second region 922 is illuminated by the second substrate 122. That is, the LED illuminating device 120 can simultaneously illuminate two separate regions.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An LED illuminating device comprising:

a heat sink comprising a first end, a second end opposite to the first end along the axial direction of the heat sink, wherein a diameter of the first end is greater than a diameter of the second end;

a first substrate mounted on the first end and comprising a plurality of light emitting diodes facing a first direction;

a second substrate mounted on the second end and comprising a plurality of light emitting diodes facing a second direction opposite to the first direction, wherein the second substrate has a size smaller than the first substrate; and a connector electrically connected with the first substrate and the second substrate.

2. The LED illuminating device of claim 1, further comprising a connecting component electrically connected with the first substrate, the second substrate and the connector.

3. The LED illuminating device of claim 1, wherein the heat sink is truncated cone structure, the heat sink further comprises a plurality of cooling fins arranged around its lateral surface, and a radial height of each cooling fin gradually decrease from the first end to the second end.

4. The LED illuminating device of claim 1, wherein the first substrate and the second substrate are substantially parallel.

5. The LED illuminating device of claim 1, wherein the first substrate and the second substrate are annular structure, a external diameter of the second substrate is less than a internal diameter of the first substrate.

6. The LED illuminating device of claim 1, wherein the first substrate is annular, and the second substrate is disc shaped, a diameter of the second substrate is less than a internal diameter of the second substrate.

7. The LED illuminating device of claim 1, further comprising a first cover mounted on the first substrate, and a second cover mounted on the second substrate.

8. The LED illuminating device of claim 7, wherein the first cover and the second cover is transparent or translucent.

9. The LED illuminating device of claim 1, further comprising a heat plate mounted between the first substrate and the heat sink.

10. The LED illuminating device of claim 1, further comprising a heat plate mounted between the second substrate and the heat sink.

11. The LED illuminating device of claim 7, wherein the first cover is engaged with the first end of the heat sink and the second cover is engaged with the second end of the heat sink.

12. The LED illuminating device of claim 11, wherein light emitted form the plurality of light emitting diodes of the second substrate radiates out of the LED illuminating device via the second cover.

13. The LED illuminating device of claim 11, wherein light emitted form the plurality of light emitting diodes of the first substrate radiates out of the LED illuminating device via the first cover.

* * * * *